US011255333B2

(12) United States Patent
Zhong

(10) Patent No.: US 11,255,333 B2
(45) Date of Patent: Feb. 22, 2022

(54) METHOD FOR IDENTIFYING IF A SUBMERSIBLE PUMP IS SUCKING PARTLY LIQUID AND PARTLY AIR

(71) Applicant: Xylem IP Management S.à r.l., Senningerberg (LU)

(72) Inventor: Zhiyong Zhong, Sundbyberg (SE)

(73) Assignee: Xylem Europe GmbH

( * ) Notice: Subject to any disclaimer, the term of this patent is extended or adjusted under 35 U.S.C. 154(b) by 306 days.

(21) Appl. No.: 16/302,209

(22) PCT Filed: May 10, 2017

(86) PCT No.: PCT/EP2017/061153
§ 371 (c)(1),
(2) Date: Nov. 16, 2018

(87) PCT Pub. No.: WO2017/198511
PCT Pub. Date: Nov. 23, 2017

(65) Prior Publication Data

US 2019/0293065 A1 Sep. 26, 2019

(30) Foreign Application Priority Data

May 17, 2016 (EP) ..... 16169951

(51) Int. Cl.
*F04D 15/02* (2006.01)
*F04B 49/06* (2006.01)
(Continued)

(52) U.S. Cl.
CPC ..... *F04D 15/0236* (2013.01); *F04B 49/025* (2013.01); *F04B 49/06* (2013.01);
(Continued)

(58) Field of Classification Search
CPC ..... F04B 19/20; F04B 2203/02; F04B 2207/044; F04D 15/0236; F04D 9/007;
(Continued)

(56) References Cited

U.S. PATENT DOCUMENTS 4,437,811 A * 3/1984 Iwata ..... F04D 15/029 417/36
5,015,151 A * 5/1991 Snyder, Jr ..... F04B 47/06 417/18
(Continued)

FOREIGN PATENT DOCUMENTS

| | | | |
|---|---|---|---|
| CN | 101203678 | A | 6/2008 |
| EP | 1893874 | B1 | 3/2008 |
| GB | 2447867 | A | 10/2008 |

OTHER PUBLICATIONS

International Search Report and Written Opinion for International Application No. PCT/EP2017/061153, dated Aug. 7, 2017—8 pages.
(Continued)

*Primary Examiner* — Nathan C Zollinger
*Assistant Examiner* — Timothy P Solak
(74) *Attorney, Agent, or Firm* — RatnerPrestia

(57) ABSTRACT

A method for stopping a submersible pump when the pump is snoring, wherein the pump is operatively connected to a control unit. The method includes regulating, by way of the control unit, the operational speed of the pump in order to direct an average power of the pump towards a predetermined set level. The method includes determining whether the instantaneous power of the pump is outside a predetermined range, by monitoring at least one of the parameters: power [P], current [I] and power factor [cos ϕ].The method further includes determining whether the operational speed of the pump is increasing, and stopping the pump due to snoring, by way of the control unit, when the instantaneous power of the pump is determined as being outside the
(Continued)

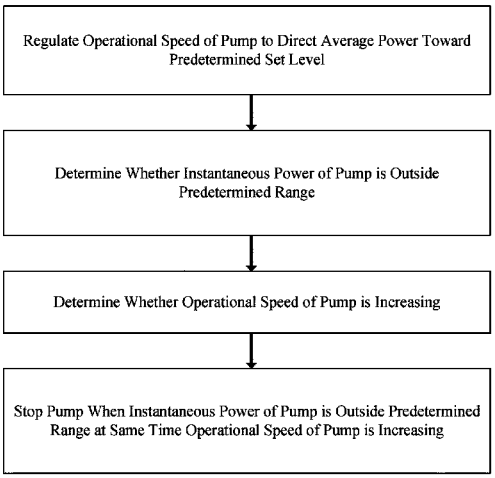

predetermined range at the same time the operational speed of the pump is determined as increasing.

12 Claims, 1 Drawing Sheet

(51) Int. Cl.

| | |
|---|---|
| ***F04D 13/08*** | (2006.01) |
| ***F04D 15/00*** | (2006.01) |
| ***F04B 49/025*** | (2006.01) |
| *F04B 47/02* | (2006.01) |
| *F04B 47/06* | (2006.01) |

(52) U.S. Cl.
CPC ..... *F04D 13/08* (2013.01); *F04D 15/0066* (2013.01); *F04B 47/02* (2013.01); *F04B 47/06* (2013.01)

(58) Field of Classification Search
CPC .... F04D 9/00; F04D 15/0227; F04D 15/0254; F04D 15/0281
See application file for complete search history.

(56) References Cited

U.S. PATENT DOCUMENTS

| | | | | |
|---|---|---|---|---|
| 6,481,973 | B1 * | 11/2002 | Struthers | F04D 7/045 417/36 |
| 2002/0176783 | A1 | 11/2002 | Moeller | |
| 2004/0064292 | A1 | 4/2004 | Beck et al. | |
| 2007/0154319 | A1 * | 7/2007 | Stiles, Jr. | F04D 15/0066 417/42 |
| 2010/0034665 | A1 * | 2/2010 | Zhong | F04D 15/0077 417/42 |
| 2010/0166570 | A1 * | 7/2010 | Hampton | F04D 9/001 417/36 |
| 2012/0027630 | A1 * | 2/2012 | Forsberg | E21B 47/008 417/423.3 |
| 2014/0334943 | A1 | 11/2014 | Koehl | |

OTHER PUBLICATIONS

Chinese Office Action for Chinese Application No. 201780030258.8, dated Jul. 20, 2020, with translation, 14 pages.

* cited by examiner

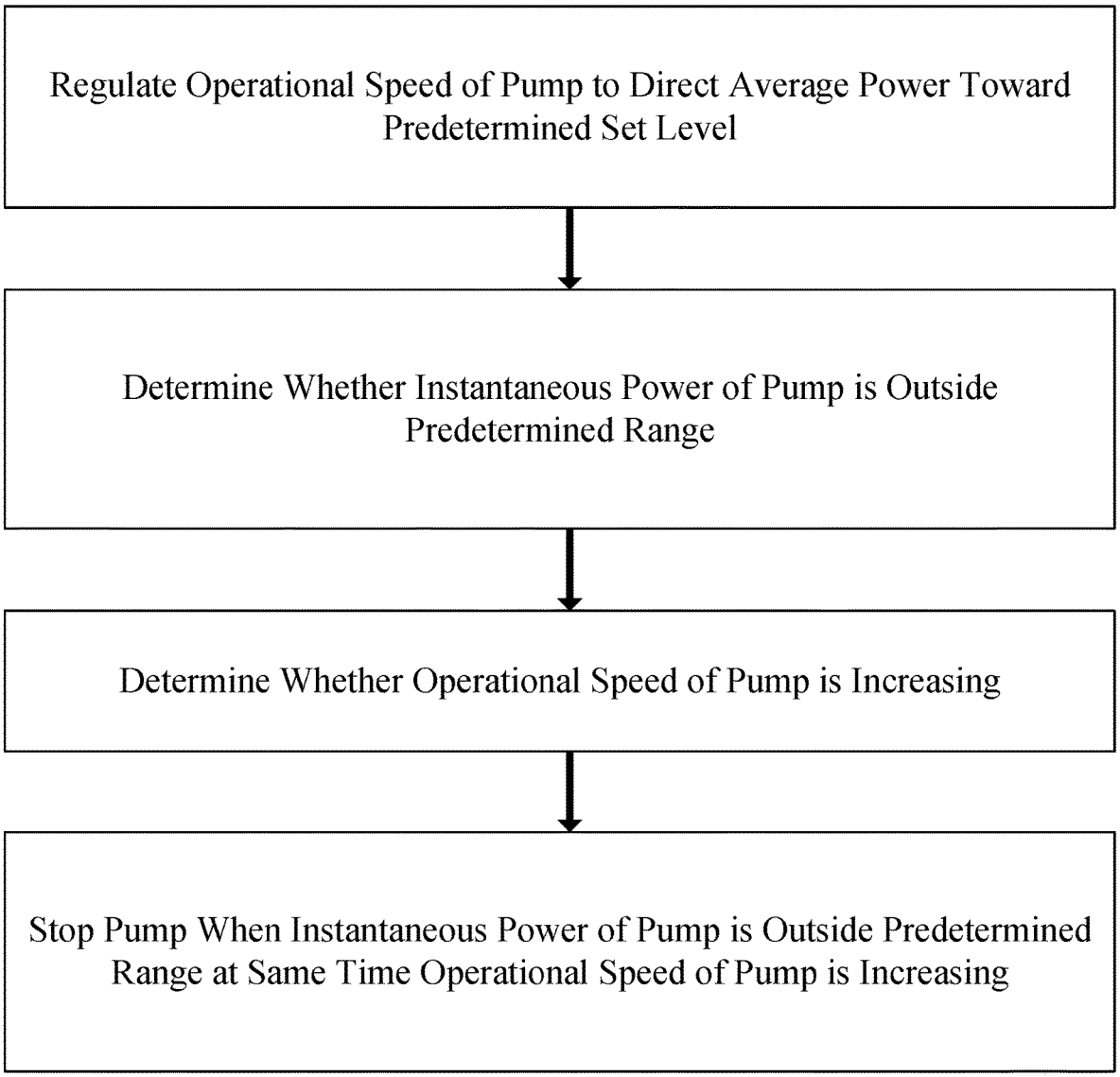
Regulate Operational Speed of Pump to Direct Average Power Toward Predetermined Set Level
Determine Whether Instantaneous Power of Pump is Outside Predetermined Range
Determine Whether Operational Speed of Pump is Increasing
Stop Pump When Instantaneous Power of Pump is Outside Predetermined Range at Same Time Operational Speed of Pump is Increasing

METHOD FOR IDENTIFYING IF A SUBMERSIBLE PUMP IS SUCKING PARTLY LIQUID AND PARTLY AIR

CROSS-REFERENCE TO RELATED APPLICATIONS

This patent application is a U.S. National Phase Patent Application of PCT Application No.: PCT/EP2017/061153, filed May 10, 2017, which claims priority to European Patent Application No. 16169951.7, filed May 17, 2016, each of which is incorporated by reference herein in its entirety.

TECHNICAL FIELD OF THE INVENTION

The present invention relates generally to the field of methods for controlling the operation of a pump suitable for pumping liquid, such as a submersible sewage/wastewater pump or a submersible drainage pump. The present invention relates more specifically to the field of methods for stopping such a pump when it is identified that the pump is snoring, i.e. when the pump sucks partly liquid and partly air. Thus, the present invention is directed towards a submersible pump that is operatively connected to a control unit, the pump being driven in operation by the control unit.

BACKGROUND OF THE INVENTION

During operation of a submersible pump there is no problem as long as the pump is able to pump liquid, i.e. the inlet of the pump is located below a liquid level. But when the liquid level falls below the inlet of the pump, the pump will start to suck partly liquid and partly air during operation. This phenomenon is called snoring, due to the snoring sound generated by the pump during such conditions.

For some applications, such as a pump station comprising a submersible sewage/wastewater pump, the pump is usually stopped by the control unit based on a stop-signal from a level sensor before the liquid level falls below the pump inlet. However, as a safety feature the pump may also be stopped when it is identified that the pump is snoring, which for instance can be the case if the level sensor malfunction. When the pump is snoring the operation of the pump is no longer productive at the same time as the pump continues to use energy, i.e. consumes a lot of energy without generating a liquid output. Thereto, the electric motor and other components of the pump might become damaged due to overheating/wear if the pump is left to snore a long period of time.

For some applications, such as a submersible drainage/de-watering pump not having a pump stop level sensor, the pump will generally be active, also when the pump is snoring, until the pump is manually turned off. If the operator of the pump is not observant and the pump is driven too long in a snoring condition, it will cause wear as well as high mechanical stress of the components of the pump, such as impeller, suction cover, seals, electric motor, etc.

There are know ways to detect snoring but they are slow and not always reliable.

OBJECT OF THE INVENTION

The present invention aims at providing an improved method for stopping a submersible pump when it is identified that the pump is snoring. A primary object of the present invention is to provide an improved method of the initially defined type that in a reliable and rapid way will detect whether the pump is snoring. It is another object of the present invention to provide a method, which makes use of the control unit that is configured to drive, the pump in operation to likewise detect snoring.

SUMMARY OF THE INVENTION

BRIEF DESCRIPTION OF DRAWING

The Figure depicts a flowchart of an exemplary method of the invention.

According to the invention at least the primary object is attained by means of the initially defined method having the features defined in the independent claim. Preferred embodiments of the present invention are further defined in the dependent claims.

According to the present invention, there is provided a method of the initially defined type, which is characterized by the steps of regulating, by means of the control unit, the operational speed of the pump in order to direct an average power of the pump towards a predetermines set level, determining whether the instantaneous power of the pump is outside a predetermined range, by monitoring at least one of the parameters: power [P], current [I] and power factor [cos $\phi$], determining whether the operational speed of the pump is increasing, and stopping the pump due to snoring, by means of the control unit, when the instantaneous power of the pump is determined as being outside the predetermined range at the same time the operational speed of the pump is determined as increasing.

Thus, the present invention is based on the understanding that for a pump driven by the control unit in such a way that the average power of the pump is directed towards a predetermined set level, i.e. the pump strive to keep the power at a constant level, by adjusting the operational speed of the pump, both the power of the pump and the operational speed of the pump are quite stable parameters during normal operation, i.e. as long as the pump is pumping liquid. However, when it is determined/identified that the operational speed of the pump is increasing at the same time as the instantaneous power of the pump fluctuates outside a predetermined range, the pump is snoring. Thereby the snoring can be detected at an early stage in an effective and easy way, by means of the control unit that monitors/controls the operational speed and power.

In a preferred embodiment of the present invention, the step of determining whether the operational speed of the pump is increasing, is performed after it has been determined that the instantaneous power of the pump is outside the predetermined range.

According to a preferred embodiment, the step of determining whether the operational speed of the pump is increasing, is performed by monitoring a trend of change of the operational speed of the pump. The operational speed of the pump will be constantly regulated by the control unit, i.e. fluctuate, independently of normal operation or snoring, and when the pump starts to pump air the control unit will compensate by increasing the operational speed of the pump.

According to a more preferred embodiment, the monitoring of the trend of change of the operational speed of the pump is performed by the steps of measuring a plurality of instantaneous operational speeds [n1, n2, n3, n4, . . . ] of the pump during a predetermined period of time [t], comparing the mutual relationship of each pair of adjacent instantaneous operational speeds [n1;n2, n2;n3, n3;n4, . . . ], monitoring the number of times [m] a latter instantaneous operational speed [n2] of a pair of adjacent instantaneous operational speeds [n1;n2]) is greater than a former instantaneous operational speed [n1] of the pair of adjacent instantaneous operational speeds [n1;n2], and confirming that the operational speed of the pump is increasing when the number of times [m] the latter instantaneous operational speed [n2] is greater than the former instantaneous operational speed [n1] is greater than a predetermined threshold, during the predetermined period of time [t].

Further advantages with and features of the invention will be apparent from the other dependent claims as well as from the following detailed description of preferred embodiments.

DETAILED DESCRIPTION OF PREFERRED EMBODIMENTS OF THE INVENTION

The present invention relates to a method for controlling the operation of a pump suitable for pumping liquid, such as a submersible sewage/wastewater pump or a submersible drainage/de-watering pump. The present invention relates to a method for stopping the pump when it is identified that the pump is snoring. According to a first embodiment the pump is stopped directly after it is confirmed that the pump is snoring, and according to a second embodiment the pump is stopped after a predetermined time period has elapsed after it is confirmed that the pump is snoring. The first embodiment is especially useful for the control of a drainage/de-watering pump and the second embodiment is especially useful for a sewage/wastewater pump arranged in a pump station. When the pump in a pump station is allowed to operate a predetermined time period when snoring, grease and other matter accumulated at the liquid surface will be sucked into the pump and transported out of the pump station.

The pump is operatively connected to a control unit, and according to a preferred embodiment the control unit is built-in into the pump. The pump is driven in operation by the control unit. In a preferred embodiment the control unit is constituted by a Variable Frequency Drive {VFD] which is configured to regulate the operational speed of the pump, for instance by regulating the frequency Hz of the alternating current supplied to the electrical motor of the pump. Thus, the control unit is configured to monitor/regulate/control the operational speed of the pump, and the control unit is also configured to monitor the power or average power of the pump. In order to monitor the power of the pump the control unit monitors at least one of the operational parameters: power [P], current [I] and power factor [cos ϕ].

According to the invention, the control unit is configured to regulate the operational speed of the pump in order to direct an average power of the pump towards a predetermined set level, in other words the pump and the control unit strive to keep the power of the pump at a constant level by adjusting the operational speed of the pump. Thus, during normal operation of the pump the average power is more or less constant. Preferably a suitable filter is used when monitoring/evaluating the average power of the pump in order to minimize the frequency of adjustment of the operational speed of the pump.

In order to detect snoring of the pump, the control unit is configured to determine whether an instantaneous power of the pump is outside a predetermined range. This is performed by monitoring at least one of the parameters: power [P], current [I] and power factor [cos ϕ]. Thus, the step of determining whether the instantaneous power is outside a predetermined range may be performed directly by monitoring the power [P] or indirectly by monitoring the current [I] or the power factor [cos ϕ]. The monitoring can be performed continuously or intermittently.

Thereto the control unit is configured to determine whether the operational speed of the pump is increasing. Preferably the step of determining whether the operational speed of the pump is increasing is performed after an affirmative determination that the instantaneous power of the pump is outside the predetermined range. Finally, the control unit is configured to stop the pump due to snoring when the instantaneous power of the pump is determined as being outside the predetermined range at the same time the operational speed of the pump is determined as increasing.

Thus, when the pump sucks partly air and partly liquid the amplitude of the fluctuation of the instantaneous power of the pump will increase, and at the same time the pump has to increase the operational speed in order to maintain the average power at the predetermined set level since for a given operational speed the instantaneous power will decrease when the pump sucks air instead of liquid.

According to a preferred embodiment the upper limit of the predetermined range of the instantaneous power of the pump is equal to or greater than a factor 1.02 times the predetermined set level of the average power of the pump, and the lower limit of the predetermined range of the instantaneous power of the pump is equal to or less than a factor 0.98 times the predetermined set level of the average power of the pump. Thus, deviations equal to or larger than 2% of the average power are considered as possible symptoms of snoring. Thus, an extremely early detection of snoring can be performed. In order to get a more reliable identification of snoring, the factor of the upper limit is equal to 1.03 and preferably equal to 1.04. In order to get a more reliable identification of snoring, the factor of the lower limit is equal to 1.03 and preferably equal to 1.04. It shall be pointed out that if the current [I] or the power factor [cos ϕ] are monitored, corresponding factors are used.

According to a first embodiment, after the pump has been stopped due to snoring, the pump is kept inactive a predetermined pause time. According to a second embodiment, after the pump has been stopped due to snoring, the pump is kept inactive until the control unit obtains a start-signal from a level sensor. Thereafter the pump is once again active until it is stopped manually, due to snoring, by a stop-signal from a level sensor, etc.

According to a preferred embodiment the step of determining whether the operational speed of the pump is increasing, is performed by monitoring a trend of change of the operational speed of the pump.

Preferably the monitoring of the trend of change of the operational speed of the pump is performed by the steps of measuring a plurality of instantaneous operational speeds [n1, n2, n3, n4, . . . ] of the pump during a predetermined period of time [t], comparing the mutual relationship of each pair of adjacent instantaneous operational speeds [n1;n2, n2;n3, n3;n4, . . . ], monitoring the number of times [m] a latter instantaneous operational speed [n2] of a pair of adjacent instantaneous operational speeds [n1;n2]) is greater than a former instantaneous operational speed [n1] of the pair of adjacent instantaneous operational speeds [n1;n2], and confirming that the operational speed of the pump is increasing when the number of times [m] the latter instantaneous operational speed [n2] is greater than the former instantaneous operational speed [n1] is greater than a predetermined threshold, during the predetermined period of time [t].

As an example, the measured plurality of instantaneous pump speeds [n1, n2, n3, n4, . . . ] is equal to or greater than ten, preferably equal to or greater than twenty. The predetermined threshold of the monitored number of times [m] the latter instantaneous operational speed [n2] is greater than the former instantaneous operational speed [n1], is equal to or greater than four, preferably equal to or greater than eight, respectively.

As an example, the predetermined period of time [t] is equal to or greater than two seconds, and equal to or less than five seconds.

According to another preferred embodiment the step of determining whether the operational speed of the pump is increasing, is performed by monitoring when the instantaneous operational speed of the pump is greater than a predetermined threshold. As an example, the threshold of the instantaneous operational speed is equal to or greater than a factor 1.03 times an average operational speed of the pump. Thus, an extremely early detection of snoring can be performed. In order to get a more reliable identification of snoring, the factor of the threshold is equal to 1.05.

Feasible Modifications of the Invention

The invention is not limited only to the embodiments described above, which primarily have an illustrative and exemplifying purpose. This patent application is intended to cover all adjustments and variants of the preferred embodiments described herein, thus the present invention is defined by the wording of the appended claims and the equipment may be modified in all kinds of ways within the scope of the appended claims.

It shall also be pointed out that even thus it is not explicitly stated that features from a specific embodiment may be combined with features from another embodiment, the combination shall be considered obvious, if the combination is possible.

The invention claimed is:

1. A method for stopping a submersible pump when the pump is snoring, wherein the pump is operatively connected to a control unit, the method comprising the steps of:

regulating, by way of the control unit, an operational speed of the pump in order to direct an average power of the pump towards a predetermined set level, determining whether an instantaneous power of the pump is outside of a predetermined range by monitoring at least one of the following parameters: power [P], current [I] and power factor [cos ϕ], determining whether the operational speed of the pump is increasing by monitoring a trend of change of the operational speed of the pump, wherein the pump is determined to be increasing if the trend of change of the operational speed of the pump is increasing based upon a plurality of measured instantaneous operational speeds of the pump over a predetermined period of time, and stopping the pump due to snoring, by way of the control unit, when the instantaneous power of the pump is determined as being outside of the predetermined range at the same time that the operational speed of the pump is determined to be increasing.

2. The method according to claim 1, wherein the step of determining whether the operational speed of the pump is increasing is performed after an affirmative determination that the instantaneous power of the pump is outside of the predetermined range.

3. The method according to claim 1, wherein the step of determining whether the operational speed of the pump is increasing is performed by monitoring for changes in the operational speed of the pump.

4. The method according to claim 3, wherein monitoring for changes in the operational speed of the pump is performed by the steps of:

measuring a plurality of instantaneous operational speeds [n1, n2, n3, n4, . . . ] of the pump during a predetermined period of time [t], comparing a mutual relationship of pairs of adjacent instantaneous operational speeds [n1;n2, n2;n3, n3; n4, . . . ], monitoring a number of times [m] a latter instantaneous operational speed [n2] of a pair of adjacent instantaneous operational speeds [n1;n2] is greater than a former instantaneous operational speed [n1] of the pair of adjacent instantaneous operational speeds [n1;n2], and confirming that the operational speed of the pump is increasing when the number of times [m] the latter instantaneous operational speed [n2] is greater than the former instantaneous operational speed [n1] is greater than a predetermined threshold during the predetermined period of time [t].

5. The method according to claim 4, wherein the plurality of instantaneous pump operational speeds [n1, n2, n3, n4, . . . ] is equal to ten.

6. The method according to claim 4, wherein the predetermined threshold of the monitored number of times [m] that the latter instantaneous operational speed [n2] is greater than the former instantaneous operational speed [n1] is equal to four.

7. The method according to claim 4, wherein the predetermined period of time [t] is equal to or greater than two seconds, and equal to or less than five seconds.

8. The method according to claim 1, wherein an upper limit of the predetermined range of the instantaneous power of the pump is equal to a factor 1.02 times the predetermined set level of the average power of the pump.

9. The method according to claim 1, wherein a lower limit of the predetermined range of the instantaneous power of the pump is equal to or less than a factor 0.98 times the predetermined set level of the average power of the pump.

10. The method according to claim 1, wherein the pump is kept inactive for a predetermined pause time after the pump has been stopped due to snoring.

11. The method according to claim 1, wherein, after the pump has been stopped due to snoring, the pump is kept inactive until the control unit obtains a start-signal from a level sensor.

12. The method according to claim 1, wherein the control unit is constituted by a variable frequency drive [VFD].

* * * * *